United States Patent [19]

Bevillard

[11] 4,401,049

[45] Aug. 30, 1983

[54] ACOUSTIC WARNING DEVICE

[75] Inventor: Jean G. Bevillard, Evreux, France

[73] Assignee: Klaxon, S.A., Courbevoie, France

[21] Appl. No.: 260,567

[22] Filed: May 5, 1981

[30] Foreign Application Priority Data

May 30, 1980 [FR] France ..... 80 12026

[51] Int. Cl.[3] ..... B06B 1/18

[52] U.S. Cl. ..... 116/142 FP; 116/59

[58] Field of Search ..... 116/142 FP, 142 FV, 116/142 R, 59; 340/388, 404

[56] References Cited

U.S. PATENT DOCUMENTS 1,076,181 10/1913 Willis ..... 340/388
1,281,877 12/1918 Teste ..... 116/142 FP
2,003,505 6/1935 Gillet ..... 116/142 FP

FOREIGN PATENT DOCUMENTS 18987 5/1914 France ..... 116/142 FP
35169 12/1929 France ..... 116/142 FP
2369644 5/1978 France ..... 116/142 FP

OTHER PUBLICATIONS

West German, Z4498 VIII d/74d; Hoppenrath; May 1956, Patentanmeldung.

*Primary Examiner*—James J. Gill
*Assistant Examiner*—Denis E. Corr
*Attorney, Agent, or Firm*—Dowell & Dowell

[57] ABSTRACT

The invention relates to an acoustic warning device (especially for automobiles) of the type comprising a diaphragm pressed by a spring on a circular lip at one extremity of a horn. According to the invention the said lip is formed on a synthetic material piece socketed on the external periphery of a tubular portion of a foot, the interior of the said tubular portion receiving, by its extremity opposite to the said piece, the said extremity of the horn.

1 Claim, 1 Drawing Figure

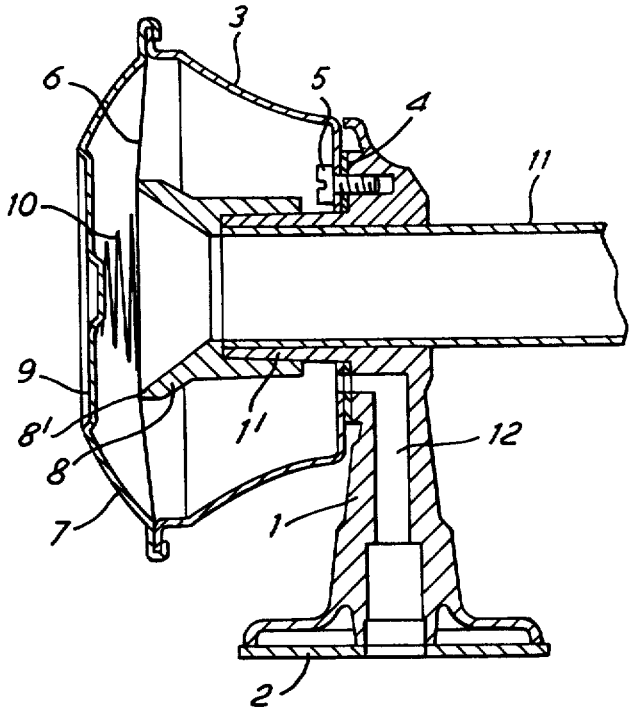
3
6
5
4
11
10
9
8'
11'
12
8
7
1
2

ACOUSTIC WARNING DEVICE

BACKGROUND TO THE INVENTION

The invention relates to pneumatic acoustic warning devices used for example an automobile vehicles and boats. The known pneumatic warning devices are constituted by a diaphragm gripped over its entire periphery and pressed by a spring against a circular lip terminating one extremity of a horn. Compressed air admitted on the periphery of the diaphragm external to this lip lifts the diaphragm against the action of the spring and penetrates into the horn, producing vibrations of the diaphragm.

In certain known warning devices the edge of the diaphragm is gripped against the periphery of a body by a screwed lid and the body comprises the pressing lip of the diaphragm and a support for the horn and a foot. The body and the lid are made by moulding from a zinc alloy which must then be subjected to surface treatment. The assembly is heavy and not very aesthetic, by reason of the moulding requirements. Furthermore it is troublesome since it necessitates a mould for each warning device model and utilises a large quantity of costly alloy. Finally it necessitates very strict inspection since any moulding defect necessitates rejection of the apparatus since any burr on the lip would involve a "wound" to the diaphragm.

OBJECT OF THE INVENTION

An object of the present invention is to eliminate the drawbacks of these known warning devices by means of a novel pneumatic acoustic warning device which is lighter, more economical, more aesthetically pleasing and more durable yet retains an acoustic quality equivalent or superior to that of known warning devices.

SUMMARY OF THE INVENTION

According to the invention there is provided an acoustic warning device comprising a foot having a conduit and an annular surface parallel to the axis of the conduit, and a tubular protruberance projecting through said annular surface, a stamped hollow sheet metal body having an annular wall at one end and an annular rim at its opposite end, means for clamping said annular wall to said annular surface, a stamped metal lid secured to said annular rim by a joint, a diaphragm secured at its margin by said joint and lying between said annular rim and said lid, a spring located between the lid and the diaphragm, a tubular moulded member mounted on said tubular protruberance and having an annular lip (8') that engages said diaphragm, and a tubular part of a horn extending extending through said tubular protuberance engaging said tubular member whereby when a pressurized pneumatic fluid is applied to said conduit said disaphragm disengages from said annular lip and said horn is actuated.

In the warning device according to the invention the diaphragm is pressed on a lip of synthetic material and thus is in no danger of damage. Moreover the foot is considerably reduced in dimensions and weight in comparison with the complex bodies of known warning devices.

In a preferred form of embodiment the periphery of the diaphragm is gripped on the periphery of a stamped sheet metal body fixed to the said foot, a lid of stamped sheet metal being crimped over the said periphery of the body and serving as support for the said return spring of the diaphragm.

BRIEF DESCRIPTION OF THE DRAWING

The invention will be clearly understood on reading of the following description given with reference to the accompanying drawings, the single FIGURE of which is an axial sectional view of the extremity comprising the diaphragm of a warning device according to one example of embodiment of the invention.

DESCRIPTION OF PREFERRED EMBODIMENT

The warning device comprises a foot 1 moulded from zinc alloy or plastics material and intended to be fixed on a bodywork through the intermediary of a gasket 2. The foot 1 is provided with an annular surface which is parallel to a conduit in the foot for entry of compressed air. A body 3 of stamped sheet metal is formed with an annular wall at one end and an annular rim at its opposite end. The body 3 is secured to the annular surface of the foot, with interposition of a gasket 4, by screws 5. A diaphragm 6 is gripped on the annular rim of the body 3 by a lid 7, a likewise of stamped sheet metal, crimped over the annular rim of the body 3.

A tubular moulded member 8 of synthetic material, such as that sold under the registered mark 'Delrin', is socketed over a tubular protuberance 1' formed integrally with and extending from the foot 1, for example by ultrasonic means. Opposite to the tubular protruberance 1' the member 8 has an annular lip 8' upon which the diaphragm 6 presses. The lid 7 has a central end piece 9 on which there presses a helical compression spring 10 likewise pressing on the diaphragm 6. A tubular part 11 of a horn (not shown in its entirety) engages within the foot 1 and its tubular protruberance 1' and is fixed by gluing.

The body 3 and the lid 7 can be made, according to need, of stainless steel, sheet aluminium, painted metal sheet, etc. The screws 5 can be replaced by studs moulded integrally with the foot 1 and crushed after the positioning of the body 3. The foot 1, comprises the usual compressed air supply conduit 12 connected to the interior of the body 3. The foot 1 can serve as basis for various warning device models, which considerably reduces the tool costs to constitute a complete range of warning devices.

I claim:

1. An accoustic warning device comprising:

(a) a moulded foot having a pneumatic inlet conduit and an annular surface parallel to the axis of the conduit, and a tubular protruberance projecting from said annular surface;

(b) a stamped hollow sheet metal body having an annular wall at one end and an annular rim at its opposite end;

(c) means for clamping said annular wall to said annular surface;

(d) a stamped metal lid secured to said annular rim by a joint;

(e) a diaphragm secured at its margin by said joint and lying between said annular rim and said lid;

(f) a spring located between the lid and the diaphragm;

(g) a tubular moulded member mounted on said tubular protruberance and having an annular projection having an annular lip that engages said diaphragm; and (h) a tubular part of a horn extending through said tubular protuberance and engaging in said tubular member, whereby a pressurized pnuematic fluid is applied to said conduit said diaphragm disengages from said annular lip and said horn is actuated.

* * * * *